US011170731B2

(12) United States Patent
Huang

(10) Patent No.: US 11,170,731 B2
(45) Date of Patent: Nov. 9, 2021

(54) METHOD AND DEVICE OF ELIMINATING SHUTDOWN AFTERIMAGE ON DISPLAY PANEL

(71) Applicant: HKC Corporation Limited, Guangdong (CN)

(72) Inventor: Beizhou Huang, Guangdong (CN)

(73) Assignee: HKC Corporation Limited, Shenzhen (CN)

( * ) Notice: Subject to any disclaimer, the term of this patent is extended or adjusted under 35 U.S.C. 154(b) by 0 days.

(21) Appl. No.: 17/059,267

(22) PCT Filed: Dec. 5, 2019

(86) PCT No.: PCT/CN2019/123371
§ 371 (c)(1),
(2) Date: Nov. 27, 2020

(87) PCT Pub. No.: WO2020/125430
PCT Pub. Date: Jun. 25, 2020

(65) Prior Publication Data

US 2021/0210045 A1 Jul. 8, 2021

(30) Foreign Application Priority Data

Dec. 19, 2018 (CN) ..... 201811560073.0

(51) Int. Cl.
*G09G 3/36* (2006.01)

(52) U.S. Cl.
CPC ..... *G09G 3/3696* (2013.01); *G09G 3/3674* (2013.01); *G09G 3/3685* (2013.01); *G09G 2320/0257* (2013.01)

(58) Field of Classification Search
CPC .. G09G 3/3696; G09G 3/3674; G09G 3/3685; G09G 2320/0257
See application file for complete search history.

(56) References Cited

U.S. PATENT DOCUMENTS

2005/0231491 A1* 10/2005 Yeh ..... G09G 3/3648 345/204
2008/0049000 A1* 2/2008 Kim ..... G09G 3/3677 345/204

(Continued)

FOREIGN PATENT DOCUMENTS

CN 203366703 U 12/2013
CN 104361866 A 2/2015

(Continued)

OTHER PUBLICATIONS

International Search Report of PCT Patent Application No. PCT/CN2019/123371 dated Mar. 6, 2020.

(Continued)

*Primary Examiner* — Ibrahim A Khan

(57) ABSTRACT

Disclosed is a method of eliminating shutdown afterimage on a panel, including: acquiring an initial voltage of a data line and a set voltage of a reference electrode; acquiring the current voltage of the data line when the display panel is turned off; and updating the set voltage of the reference electrode according to the initial voltage of the data line and the current voltage of the data line. The present application further discloses a method and a device of eliminating the shutdown afterimage on the display panel.

18 Claims, 5 Drawing Sheets

(56) References Cited

U.S. PATENT DOCUMENTS

2008/0129903 A1* 6/2008 Hong ..... G09G 3/3648 349/36
2008/0165109 A1* 7/2008 Joo ..... G09G 3/3677 345/98
2008/0303762 A1* 12/2008 Yasuda ..... G09G 3/3655 345/87
2009/0040244 A1* 2/2009 Lee ..... G09G 3/3696 345/690
2009/0231253 A1* 9/2009 Hu ..... G09G 3/3648 345/87
2009/0231259 A1* 9/2009 Yu ..... G09G 3/3688 345/92
2010/0097365 A1* 4/2010 Fang ..... G09G 3/3696 345/212
2012/0182282 A1* 7/2012 van Veenendaal ..... G09G 3/344 345/212
2012/0217517 A1 8/2012 Choi et al.
2014/0111556 A1 4/2014 Chen
2015/0042548 A1* 2/2015 Liu ..... G09G 3/3677 345/93
2015/0049071 A1* 2/2015 Kaneko ..... G09G 3/3648 345/211
2015/0379954 A1* 12/2015 Choi ..... G09G 3/3611 345/690
2016/0140890 A1* 5/2016 Kim ..... G09G 3/3614 345/690
2016/0291789 A1* 10/2016 Zhai ..... G06F 3/04166
2016/0372075 A1* 12/2016 Kuo ..... G09G 3/3614
2018/0040288 A1* 2/2018 Ohn ..... G09G 3/3677
2019/0122630 A1* 4/2019 Kwon ..... G09G 3/3614
2020/0020299 A1* 1/2020 Xu ..... G09G 5/008
2021/0119534 A1* 4/2021 Zhu ..... H02M 3/156
2021/0142757 A1* 5/2021 Hu ..... G09G 3/3655

FOREIGN PATENT DOCUMENTS

CN 104795035 A 7/2015
CN 105632435 A 6/2016
CN 106842750 A 6/2017
CN 106847226 A 6/2017
CN 106898326 A 6/2017
CN 106950768 A 7/2017
CN 108121094 A 6/2018
CN 108257565 A 7/2018
CN 108962165 A 12/2018

OTHER PUBLICATIONS

1st Office Action of counterpart Chinese Patent Application No. 201811560073.0 dated Feb. 3, 2020.
3rd Office Action of counterpart Chinese Patent Application No. 201811560073.0 dated Oct. 13, 2020.
2nd Office Action of counterpart Chinese Patent Application No. 201811560073.0 dated Jul. 6, 2020.

* cited by examiner

METHOD AND DEVICE OF ELIMINATING SHUTDOWN AFTERIMAGE ON DISPLAY PANEL

CROSS-REFERENCE TO RELATED APPLICATIONS

The present application is the national stage of a PCT application No. PCT/CN2019/123371, filed on Dec. 5, 2019 which claims the priority of the Chinese patent application filed on Dec. 19, 2018, with the application number of 201811560073.0 and the title of "Method and device of eliminating shutdown afterimage on the display panel", which is hereby incorporated by reference in its entirety.

FIELD

The present application relates to display, in particular to a method and a device of eliminating a shutdown afterimage on a display panel.

BACKGROUND

The statements herein merely provide background information related to the present application and do not necessarily constitute prior art.

In order to reduce the color shift of LCD and improve the viewing angle range, LCD is usually designed with low color shift. Generally, a pixel can be divided into four areas by increasing the area of the pixel. However, if a pixel is divided into a main pixel area and a sub-pixel area, it can be increased to eight areas, thus improving the color cast and increasing the viewing angle. Particularly, a plurality of different Thin Film Transistor (TFTs) are used to supply power to the pixel region (3T pixel design), that is, three TFTs are used to charge and discharge two pixel regions. When the gate line is turned on, charges are sent to the main pixel area and the sub-pixel area of the pixel through the main TFT and the sub-TFT, respectively. After the gate line is turned off, the charge sharing TFT is turned on to release part of the charge in the sub-pixel area into the charge sharing capacitor. Therefore, there is a potential difference between the sub-pixel area and the main pixel area, and the tilt angle of the liquid crystal is different, thus reducing color cast.

For the above-mentioned LCD with low color shift design, when the thin film transistors of all pixel electrodes are turned on by using the level control signal (XON) function on the driving integrated circuit to quickly discharge the pixel Array Com solve the shutdown afterimage problem, the gate full-open charge sharing TFT is always turned on, and the Array Com (A Com) is connected with the data line. The electric energy stored in the array flows to the data line, which causes the data level to be raised or lowered. Therefore, the difference between the voltage level of the data line and the voltage of the reference electrode (CF Com, C Com for short) is large, resulting in that the charge in the pixel area cannot be completely discharged, and the shutdown afterimage cannot be eliminated.

SUMMARY

The present application provides a method of eliminating a shutdown afterimage on a display panel, which includes the following operations:

acquiring an initial voltage of a data line and a set voltage of a reference electrode;

acquiring a current voltage of the data line, in response to the display panel being turned off, and updating the set voltage of the reference electrode according to the initial voltage of the data line and the current voltage of the data line.

In some of the embodiments, the operation of updating the set voltage of the reference electrode according to the initial voltage of the data line and the current voltage of the data line, includes:

acquiring a voltage difference between the initial voltage of the data line and the current voltage of the data line; and updating the set voltage of the reference electrode according to the voltage difference.

In some of the embodiments, the operation of updating the set voltage of the reference electrode according to the voltage difference, includes:

acquiring a voltage sum of the voltage difference and the set voltage of the reference electrode before updating; and updating the set voltage of the reference electrode according to the voltage sum.

In some of the embodiments, the operation of updating the set voltage according to the voltage sum, includes:

determining a modulated voltage according to the voltage sum, wherein the difference between the modulated voltage and the voltage sum is within a first preset range; and taking the modulated voltage as a set voltage of the reference electrode after updating.

In some of the embodiments, the operation of updating the set voltage of the reference electrode according to the voltage difference, includes:

determining a modulated voltage difference according to the voltage difference, wherein a difference between the modulated voltage difference and the voltage difference is within a second preset range; and updating the set voltage of the reference electrode according to the modulated voltage difference.

In some of the embodiments, the second preset range is between −0.5V and +0.5V.

In some of the embodiments, prior to the operation of updating the set voltage of the reference electrode according to the initial voltage of the data line and the current voltage of the data line, the method further includes:

acquiring a voltage difference between a current voltage of the data line and an initial voltage of the data line;

determining whether an absolute value of the voltage difference is greater than a preset threshold; and in response to the absolute value being greater than a preset threshold, executing the operation of updating the set voltage of the reference electrode according to the initial voltage of the data line and the current voltage of the data line.

In some of the embodiments, prior to the operation of prior to the operation of acquiring a current voltage of the data line, the method further includes:

detecting whether a charge sharing thin film transistor in a drive of the display panel is communicated with the data line, in response to the display panel being turned off, and executing the operation of acquiring the current voltage of the data line, if the charge sharing thin film transistor is communicated with the data line.

Further, the present application provides a method of eliminating the shutdown afterimage on the display panel, including:

acquiring an initial voltage of a data line and a set voltage of a reference electrode;

detecting whether a charge sharing thin film transistor in a drive of the display panel is communicated with the data line, in response to the display panel being turned off; and acquiring a voltage difference between an initial voltage of the data line and the current voltage, when the charge sharing thin film transistor is communicated with the data line; and updating the set voltage of the reference electrode according to the voltage difference.

In some of the embodiments, the operation of detecting whether a charge sharing thin film transistor in a drive of the display panel is communicated with the data line, comprises:

if gate lines in the drive of the display panel are all opened, determining that the charge sharing thin film transistor is communicated with the data line.

In some of the embodiments, the operation of updating the set voltage of the reference electrode according to the voltage difference, includes:

acquiring a voltage sum of the voltage difference and the set voltage of the reference electrode before updating; and updating the set voltage of the reference electrode according to the voltage sum.

In some of the embodiments, the operation of updating the set voltage according to the voltage sum, includes:

determining a modulated voltage according to the voltage sum, wherein the difference between the modulated voltage and the voltage sum is within a first preset range; and taking the modulated voltage as a set voltage of the reference electrode after updating.

In some of the embodiments, the operation of updating the set voltage of the reference electrode according to the voltage difference, includes:

determining a modulated voltage difference according to the voltage difference, wherein a difference between the modulated voltage difference and the voltage difference is within a second preset range; and updating the set voltage of the reference electrode according to the modulated voltage difference.

In some of the embodiments, prior to the operation of updating the set voltage of the reference electrode according to the initial voltage of the data line and the current voltage of the data line, the method further includes:

acquiring a voltage difference between a current voltage of the data line and an initial voltage of the data line;

determining whether an absolute value of the voltage difference is greater than a preset threshold; and in response to the absolute value being greater than a preset threshold, executing the operation of updating the set voltage of the reference electrode according to the initial voltage of the data line and the current voltage of the data line.

Further, the present application provides a device of eliminating the shutdown afterimage on the display panel. The device includes a memory, a processor and a program for eliminating a shutdown image stored in the memory, the program including instructions, when executed by the processor, cause the device to implement the operations of eliminating the shutdown afterimage on the display panel as described above.

In some of the embodiments, the operation of updating the set voltage of the reference electrode according to the initial voltage of the data line and the current voltage of the data line, includes:

acquiring a voltage difference between the initial voltage of the data line and the current voltage of the data line; and updating the set voltage of the reference electrode according to the voltage difference.

In some of the embodiments, prior to the operation of updating the set voltage of the reference electrode according to the initial voltage of the data line and the current voltage of the data line, the method further includes:

acquiring a voltage difference between a current voltage of the data line and an initial voltage of the data line;

determining whether an absolute value of the voltage difference is greater than a preset threshold; and in response to the absolute value being greater than a preset threshold, executing the operation of updating the set voltage of the reference electrode according to the initial voltage of the data line and the current voltage of the data line.

The embodiment of the present application provides a method and a device of eliminating the shutdown afterimage on a display panel. Before the display panel is shut down, an initial voltage of a data line and a set voltage of a reference electrode are detected by a voltage detecting element. After the display panel is turned off, the current voltage of the data line is detected. The reference electrode in the control system of the display panel is set as being modulated. When the display panel is turned off, the set voltage of the reference electrode is updated according to the initial voltage of the data line and the current voltage of the data line, so that the difference between the voltage level corresponding to the current voltage of the data line and the updated set voltage is less than a certain value. Therefore, the charge in the pixel structure is effectively released, the image of the display panel turns black, and the afterimage problem is solved.

The implementation, functional characteristics and advantages of the present application will be further described with reference to the attached drawings in combination with embodiments.

DETAILED DESCRIPTION OF EMBODIMENTS

It should be understood that the specific embodiments described herein are only for illustrative purpose and are not intended to limit the present application.

The main solution to the embodiments of the present application is as follows:

acquiring an initial voltage of a data line and a set voltage of a reference electrode;

acquiring a current voltage of the data line, in response to the display panel being turned off, and updating the set voltage of the reference electrode according to the initial voltage of the data line and the current voltage of the data line.

In the existing liquid crystal panel with 3T pixel design, when the power is turned off, the grid full-open charge sharing TFT is always turned on, the Array Com (ACom) is connected with the data line, and the electric energy stored in the array flows to the data line, so that the charge in the pixel area cannot be completely released, and the shutdown afterimage cannot be eliminated.

The present application provides a solution that the initial voltage of the data line and the set voltage of the reference electrode are detected by a voltage detecting element before the display panel is turned off. After the display panel is turned off, the current voltage of the data line is detected. The set voltage of the reference electrode in a control system of the display panel is set as being adjustable. When the display panel is turned off, the set voltage of the reference electrode is updated according to the initial voltage of the data line and the current voltage of the data line, so that the difference between the voltage level corresponding to the current voltage of the data line and the updated set voltage is less than a certain value. Therefore, the charge in the pixel structure is effectively released, the image of the display panel turns black, and the afterimage problem is solved.

Figure 1:
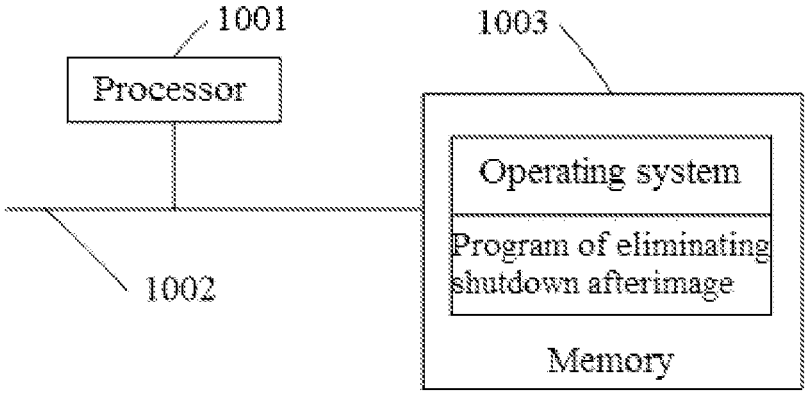
FIG. 1 is a schematic diagram of a terminal of a hardware operating environment according to some embodiments of the present application.

As shown in FIG. 1, which is a schematic diagram of a terminal of a hardware operating environment involved in some embodiments of the present application.

The terminal can be a television, a display, a portable compute, a tablet computer, a smart phone and other terminal device with a liquid crystal panel.

As shown in FIG. 1, the terminal may include a processor 1001, such as a central processing unit (CPU), a memory 1002, and a communication bus 1003. In which, the communication bus 1003 is configured to implement connecting and communication between various components of the terminal. The memory 1002 may be a high-speed random access memory or a non-volatile memory, such as a magnetic disk memory. In some of the embodiments, the memory 1002 may also be a storage device independent of the aforementioned processor 1001.

It would be understood by those skilled in the art that the terminal shown in FIG. 1 does not constitute a limitation to the terminal of the present application, which may include more or fewer components than shown, or some components may be combined, or different components arranged.

As shown in FIG. 1, the memory 1002, which is a computer storage medium, can include an operating system and a program for eliminating the shutdown afterimage.

In the server shown in FIG. 1, the processor 1001 can be used to call the program for eliminating the shutdown afterimage stored in the memory 1002, and perform the following operations:

acquiring an initial voltage of a data line and a set voltage of a reference electrode;

acquiring a current voltage of the data line, in response to the display panel being turned off, and updating the set voltage of the reference electrode according to the initial voltage of the data line and the current voltage of the data line.

Further, the processor 1001 may call the program for eliminating the shutdown afterimage stored in the memory 1002, and perform the following operations:

acquiring a voltage difference between the initial voltage of the data line and the current voltage of the data line; and updating the set voltage of the reference electrode according to the voltage difference.

Further, the processor 1001 may call the program for eliminating the shutdown afterimage stored in the memory 1002, and perform the following operations:

acquiring a voltage sum of the voltage difference and the set voltage of the reference electrode before updating; and updating the set voltage of the reference electrode according to the voltage sum.

Further, the processor 1001 may call the program for eliminating the shutdown afterimage stored in the memory 1002, and perform the following operations:

determining a modulated voltage according to the voltage sum, wherein the difference between the modulated voltage and the voltage sum is within a first preset range; and taking the modulated voltage as a set voltage of the reference electrode after updating.

Further, the processor 1001 may call the program for eliminating the shutdown afterimage stored in the memory 1002, and perform the following operations:

determining a modulated voltage difference according to the voltage difference, wherein a difference between the modulated voltage difference and the voltage difference is within a second preset range; and updating the set voltage of the reference electrode according to the modulated voltage difference.

Further, the processor 1001 may call the program for eliminating the shutdown afterimage stored in the memory 1002, and perform the following operations:

acquiring a voltage difference between a current voltage of the data line and an initial voltage of the data line;

determining whether an absolute value of the voltage difference is greater than a preset threshold; and in response to the absolute value being greater than a preset threshold, executing the operation of updating the set voltage of the reference electrode according to the initial voltage of the data line and the current voltage of the data line.

Further, the processor 1001 may call the program for eliminating the shutdown afterimage stored in the memory 1002, and perform the following operations:

detecting whether a charge sharing thin film transistor in a drive of the display panel is communicated with the data line, in response to the display panel being turned off; and executing the operation of acquiring the current voltage of the data line, if the charge sharing thin film transistor is communicated with the data line.

Further, the processor 1001 may call the program for eliminating the shutdown afterimage stored in the memory 1002, and perform the following operations:

acquiring an initial voltage of a data line and a set voltage of a reference electrode;

detecting whether a charge sharing thin film transistor in a drive of the display panel is communicated with the data line, in response to the display panel being turned off;

acquiring a voltage difference between an initial voltage of the data line and the current voltage, when the charge sharing thin film transistor is communicated with the data line; and updating the set voltage of the reference electrode according to the voltage difference.

Further, the processor 1001 may call the program for eliminating the shutdown afterimage stored in the memory 1002, and perform the following operations:

acquiring a voltage sum of the voltage difference and the set voltage of the reference electrode before updating;

updating the set voltage of the reference electrode according to the voltage sum.

Figure 2:
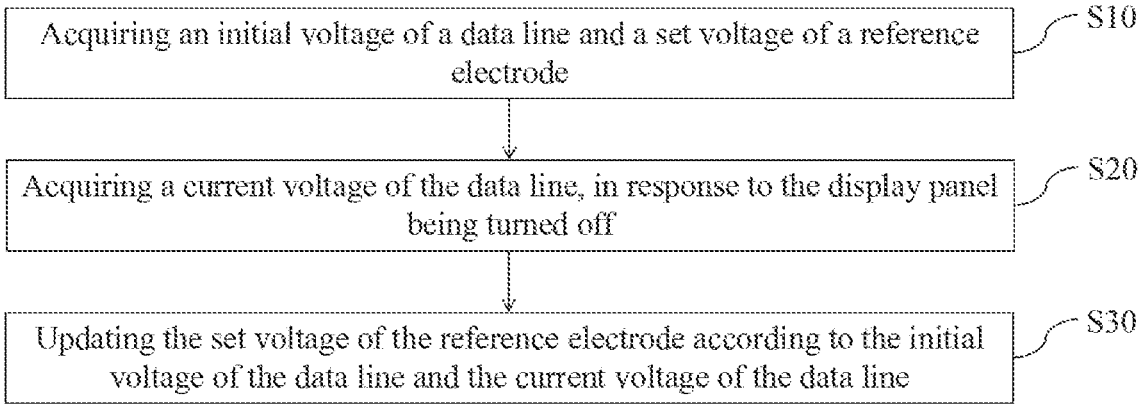
FIG. 2 is a flow chart of a method of eliminating a shutdown afterimage on a display panel according to an embodiment of the present application.

Referring to FIG. 2, an embodiment of the method of eliminating the shutdown afterimage on the display panel, the method may include:

operation S10, acquiring an initial voltage of a data line and a set voltage of a reference electrode;

operation S20, acquiring a current voltage of the data line, in response to the display panel being turned off.

When a liquid crystal display displays an image, charges are accumulated in the storage capacitor between two opposite electrodes (such as a reference electrode and a pixel electrode). When the power supply of the liquid crystal display panel is turned off, these accumulated charges will make the corresponding pixels in different gray scales, thus leaving afterimage on the display screen.

In order to solve the problem of afterimage after shutdown of liquid crystal display, in some related technologies, the level control signal (Xon) on the driving integrated circuit (IC) is used to turn on thin film transistors of all pixel structures after the power of the liquid crystal display is turned off, so that the pixels can be quickly discharged. Xon function here means that after Xon pin of the gate driving integrated circuit receives the shutdown signal of the display panel, the gate driving integrated circuit raises the output voltage of all output terminals to high potential voltage, and turns on the gates of all thin film transistors in the liquid crystal display panel, so as to forcibly neutralize and release the charge in the pixel structure quickly, thus achieving the purpose of eliminating the afterimage.

Figure 3:
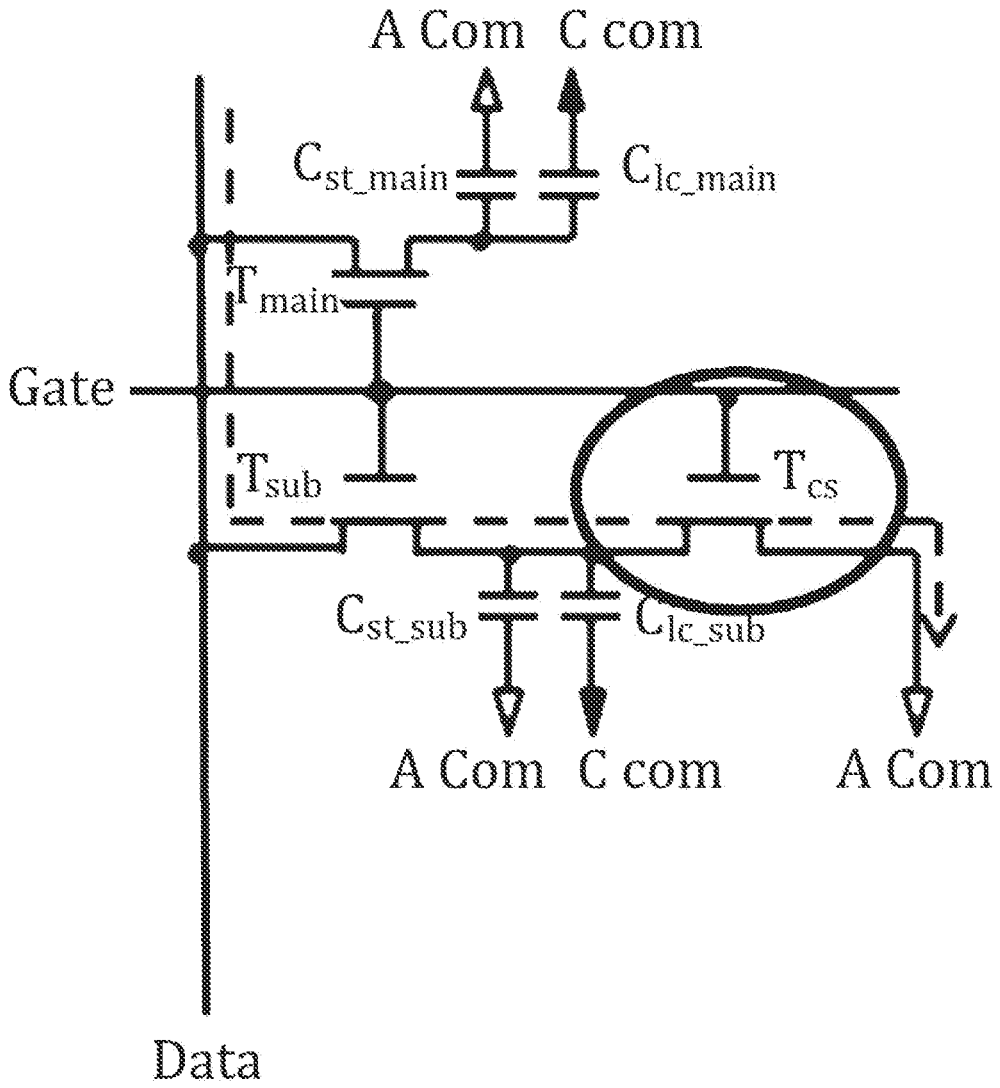
FIG. 3 is an equivalent circuit diagram of 3T pixel design regarding the present application.

However, for some display panels, when the thin film transistors of all pixel structures are turned on, the charge sharing TFT is always turned on, and the Array Com (A Com) is connected with the data line, and the electric energy stored in the array flows to the data line, resulting in the voltage level of the data line being raised or lowered, thus causing a large difference between the voltage level of the data line and the voltage of the reference electrode, and the charge in the pixel structure cannot be effectively discharged. For example, in the display panel with low color shift design shown in FIG. 3, when the display panel is turned off, Tcs is turned on, A Com communicates with Data, and electric energy in A Com flows to Data.

In order to avoid the influence of the Array Com on the voltage of the data line, this application provides a method of eliminating the shutdown afterimage on the display panel. Before the display panel is shut down, the initial voltage (positive half-cycle voltage) of the data line and the set voltage of the reference electrode are detected by the voltage detecting element. After the display panel is turned off, the current voltage (positive half-cycle voltage) of the data line is detected.

operation S30, updating the set voltage of the reference electrode according to the initial voltage of the data line and the current voltage of the data line.

The reference electrode in the control system of the display panel is set as being modulated. When the display panel is turned off, the set voltage of the reference electrode is updated according to the initial voltage of the data line and the current voltage of the data line, so that the difference between the voltage level corresponding to the current voltage of the data line and the updated set voltage of the reference electrode is less than a certain value. Therefore, the charge in the pixel structure is effectively released, the image of the display panel turns black, and the afterimage problem is solved.

According to the different models of the display panel, after the display panel is turned off, the voltage difference is different to blacken the display panel for eliminating the shutdown afterimage. Usually, the value range of the voltage difference is from −0.5V to +0.5V.

For example, before a display panel is turned off, it is detected that a initial voltage of a data line is 4V and a set voltage of a reference electrode is 2V. When the display panel is turned off, it is detected that the current voltage of the data line is 5V, and the voltage difference compared with the initial voltage is 1V. Then, the set voltage of the reference electrode is updated to 3V(4V+1V). That is, after the data line is affected by the Array Com, the voltage level of the data line changes by 1V. At this time, the set voltage of the reference electrode is adjusted by 1V accordingly, so that the difference between the voltage level of the data line and the voltage of the reference electrode remains unchanged, the charge in the pixel structure is released, and the screen of the display panel turns black, thus solving the problem of afterimage. It should be pointed out that in this example, if the value of the voltage difference is from −0.3V to +0.3V, updating the set voltage of the reference electrode to any value in the range from +4.7 V to +5.3V can solve the shutdown afterimage problem.

Figure 4:
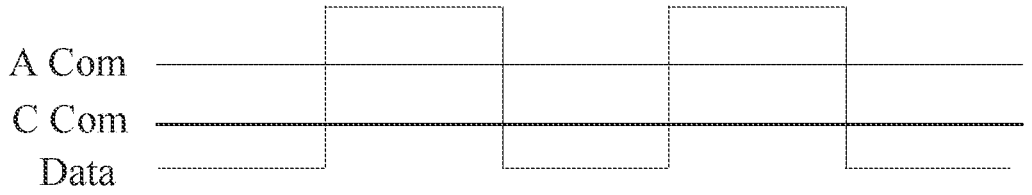
FIG. 4 is a schematic diagram showing pixel charging voltage according to an embodiment of the present application.
Figure 5:
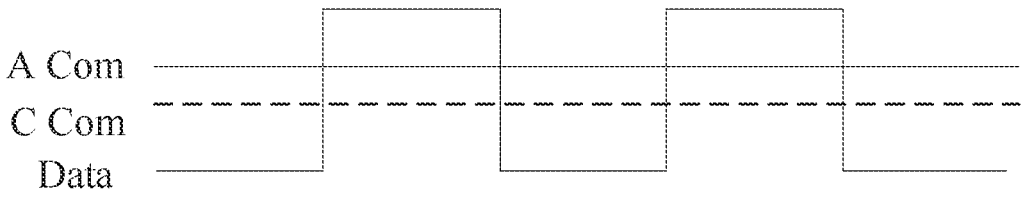
FIG. 5 is a schematic diagram showing another pixel charging voltage according to a first embodiment of the present application.

As shown in FIG. 4, after the display panel is turned off, the Array Com (A Com) influences the voltage of the electrode line (Data), and shifts the voltage level of the electrode line (the voltage level of the electrode line is between the positive half-cycle voltage and the negative half-cycle voltage of the electrode line, which is not shown in the figure). There is a large voltage difference between the voltage level of the electrode line and the set voltage of the reference electrode (C Com). After updating the set voltage of the reference electrode, as shown in FIG. 5, with the change of the voltage of the reference electrode (C Com), the voltage difference between the voltage level of the electrode line and the voltage of the reference electrode (C Com) is less, the charge in the pixel structure is released, and the display panel picture becomes black, thus solving the afterimage problem.

In addition, the updating method of the set voltage of the reference electrode is not limited to the above method provided in this embodiment, and any updating method of the set voltage of the reference electrode that can achieve the following effects after the set voltage is updated belongs to the protection scope of this application. The effect is that the voltage difference between the set voltage of the updated reference electrode and the voltage level of the data line is less than a certain voltage.

In this embodiment, before the display panel is shut down, the initial voltage of the data line and the set voltage of the reference electrode are detected by a voltage detecting element. After the display panel is turned off, the current voltage of the data line is detected. The reference electrode in the control system of the display panel is set as being modulated. When the display panel is turned off, the set voltage of the reference electrode is updated according to the initial voltage of the data line and the current voltage of the data line, so that the difference between the voltage level corresponding to the current voltage of the data line and the updated set voltage is less than a certain value. Therefore, the charge in the pixel structure is effectively released, the image of the display panel turns black, and the afterimage problem is solved.

Figure 6:
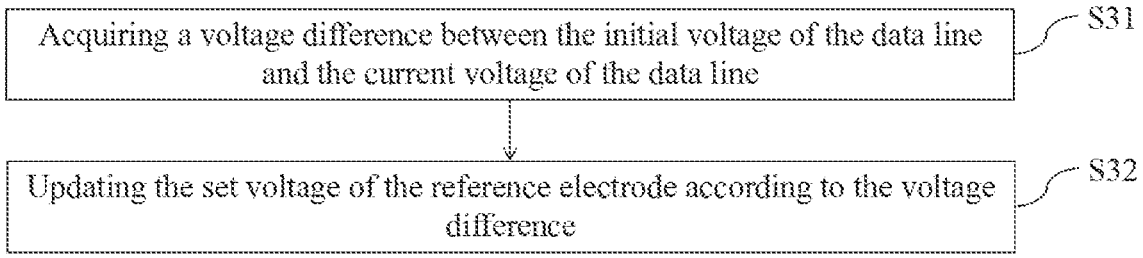
FIG. 6 is a flow chart of a method of eliminating a shutdown afterimage on a display panel according to a second embodiment of the present application.

In some of the embodiments, FIG. 6 is referred to. Based on the aforementioned first embodiment, the operation S30 includes:

operation S31, acquiring a voltage difference between the initial voltage of the data line and the current voltage of the data line.

operation S32, updating the set voltage of the reference electrode according to the voltage difference.

The updating method of the set voltage of the reference electrode can be as follows: firstly, calculate the voltage difference between the initial voltage and the current voltage of the data line, and update the set voltage of the reference electrode according to the voltage difference. When updating the set voltage of the reference electrode according to the voltage difference, the set voltage of the reference electrode before updating and the voltage difference are added to obtain a voltage sum, and then the set voltage is updated according to the voltage sum. Specifically, a modulated voltage is determined according to the voltage sum, and the modulated voltage is taken as the updated set voltage of the reference electrode. The difference between the modulated voltage and the voltage sum is within a first preset range, so that the voltage difference between the updated set voltage and the voltage level of the data line is less than a certain voltage.

In addition, the method of updating the set voltage may be as follows: after acquiring the voltage difference between the initial voltage and the current voltage of the data line, a modulated voltage difference is determined according to the voltage difference, and the set voltage of the reference electrode is updated according to the modulated voltage difference. Specifically, the updated set voltage can be set as the sum of the modulated voltage difference and the set voltage before updating. Similarly, the difference between the modulated voltage difference and the voltage difference is within a second preset range, so that the voltage difference between the updated set voltage and the voltage level of the data line is less than a certain voltage.

It should be pointed out that the voltage difference mentioned in this application includes positive and negative values, and when the voltage difference is summed with other parameters, the positive and negative signs of the voltage difference should be taken into account.

According to different models of the display panel, different first preset ranges and second preset ranges are set. When the voltage difference between the voltage level of the data line and the set voltage of the reference electrode is less than a certain voltage, the display panel can be blackened after shutdown. Usually, ranges of the first preset range and the second preset range are from −0.5V to +0.5V. In this embodiment, the first preset range may be the same as or different from the second preset range.

In this embodiment, the voltage difference between the initial voltage of the data line and the current voltage is acquired, and then the set voltage of the reference electrode is updated according to the voltage difference. By adjusting the set voltage of the reference electrode according to the voltage difference between the initial voltage and the current voltage of the data line, it can be ensured that the voltage difference between the updated set voltage of the reference electrode and the voltage level of the data line is within the blackening range of the display panel, to effectively solve the problem of the shutdown afterimage of the display panel.

Figure 7:
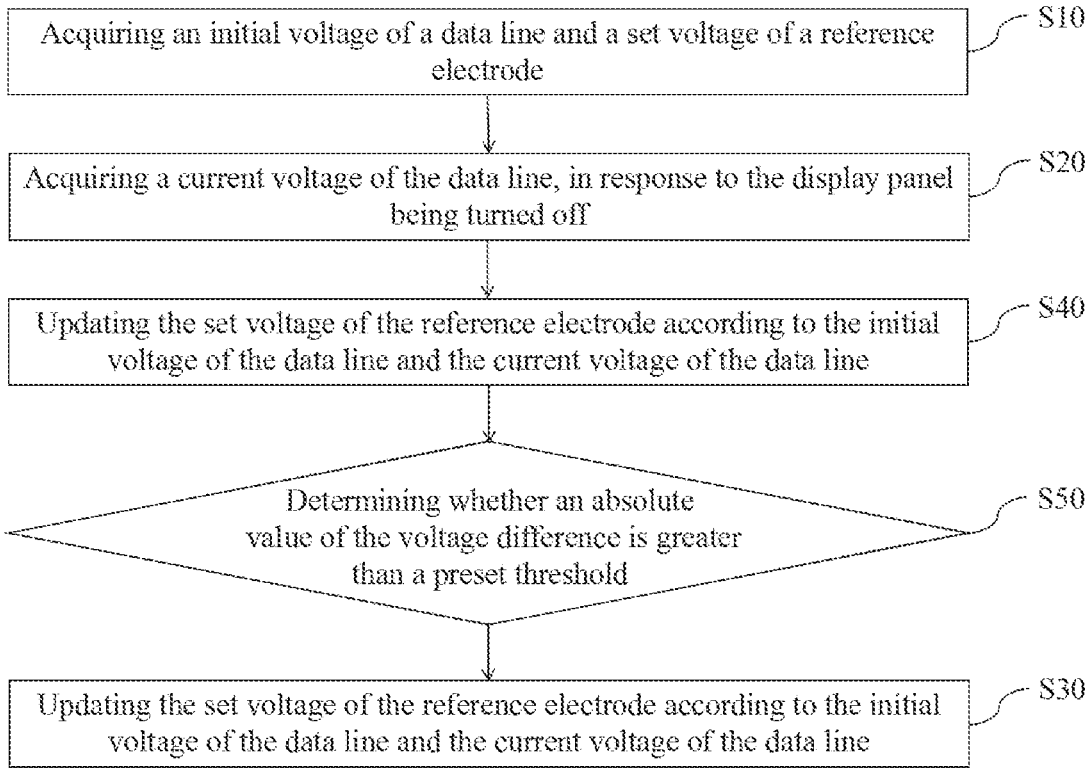
FIG. 7 is a flow chart of a method of eliminating a shutdown afterimage on a display panel according to a third embodiment of the present application.

In some of the embodiments, FIG. 7 is referred to. Based on the aforementioned embodiments, before the operation S30, the method includes:

operation S40, acquiring a voltage difference between a current voltage of the data line and an initial voltage of the data line;

operation S50, determining whether an absolute value of the voltage difference is greater than a preset threshold;

in response to the absolute value being greater than a preset threshold, the operation S30 is executed to update the set voltage of the reference electrode according to the initial voltage of the data line and the current voltage of the data line.

After acquiring the initial voltage and current voltage of the data line, the voltage difference between the current voltage and the initial voltage is calculated first. If the absolute value of the voltage difference is within a certain preset threshold, it indicates that the pixel of the last picture before shutdown has little influence on the Array Com, and the voltage change is small, so that the voltage change of the data line is within a certain acceptable range under the influence of the Array Com, thus the voltage level offset of the data line is small. As a result, the charge in the pixel structure can be released and the blackening requirement of the display panel is fulfilled, so that the shutdown afterimage is avoided. On the contrary, if the absolute value of the voltage difference is greater than a certain preset threshold, the current voltage of the Array Com has great influence on the voltage of the data line, and the voltage level offset of the data line is too large to turn the display panel black, resulting in the shutdown afterimage.

Therefore, judgment is introduced in the control system of the display panel, to judge if the absolute value of the voltage difference is greater than the preset threshold. When the absolute value of the voltage difference is greater than the preset threshold, operation S30 is executed to adjust the set voltage of the reference electrode. When the absolute value of the voltage difference is less than the preset threshold, there is no need to execute the adjustment operation of the voltage. Reduce program operation and improve shutdown efficiency.

Furthermore, when judging whether the set voltage of the reference electrode needs to be updated, the pixel gray scale of the last picture before the display panel is turned off is obtained. When the gray scale is very low and the picture brightness is low, the pixels have little influence on the voltage of the Array Com, so the set voltage of the Array Com is not updated.

In this embodiment, after acquiring the initial voltage and current voltage of the data line, the voltage difference between the current voltage and the initial voltage is calculated first. It is judged if the absolute value of the voltage difference is greater than the preset threshold. When the absolute value of the voltage difference is greater than the preset threshold, operation S30 is executed to adjust the set voltage of the reference electrode. When the absolute value of the voltage difference is less than the preset threshold, there is no need to execute the adjustment operation of the voltage. Reduce program operation and improve shutdown efficiency.

Figure 8:
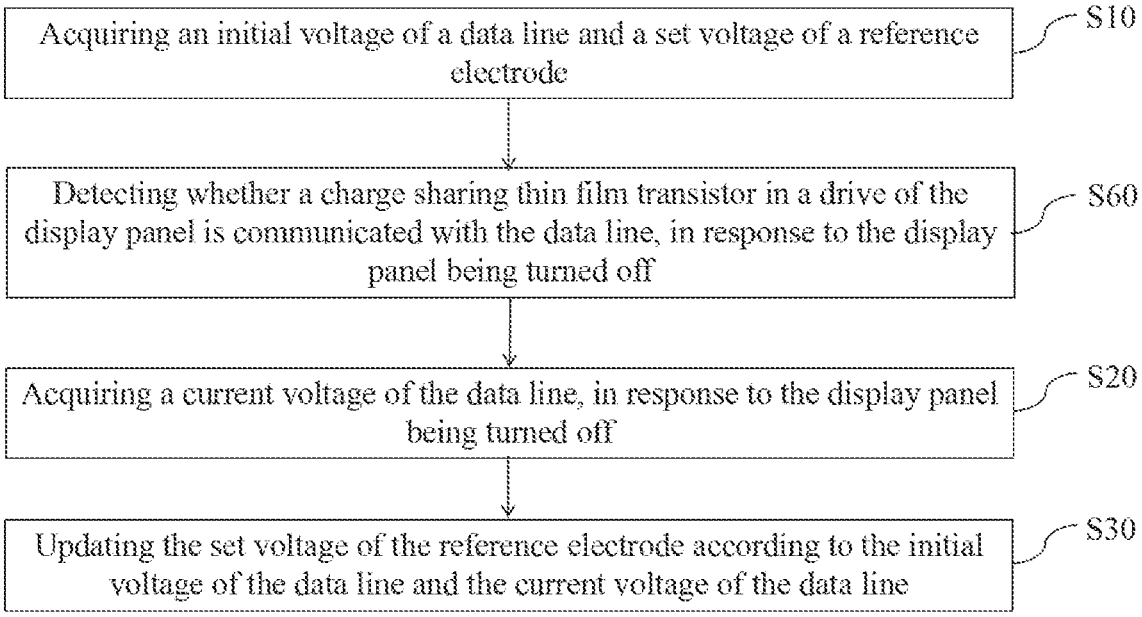
FIG. 8 is a flow chart of a method of eliminating a shutdown afterimage on a display panel according to a fourth embodiment of the present application.

In some of the embodiments, FIG. 8 is referred to. Based on the aforementioned embodiments, before operation S20, the method further includes:

operation S60, detecting whether a charge sharing thin film transistor in a drive of the display panel is communicated with the data line, in response to the display panel being turned off.

Operation S20 is executed to acquire the current voltage of the data line, if the charge sharing thin film transistor is communicated with the data line.

When the charge sharing thin film transistor of the display panel is communicated with the data line, the electric energy stored in the Array Com flows to the data line, which affects the voltage of the data line, and the voltage difference between the voltage level of the data line and the set voltage of the reference electrode increases, so that the charge in the pixel structure can not be effectively released, resulting in the problem of the shutdown afterimage of the display panel.

Therefore, it is detected whether a charge sharing thin film transistor in a drive of the display panel is communicated with the data line, in response to the display panel being turned off. When the charge sharing thin film transistor in the drive of the display panel is communicated with the data line, the operation of updating the set voltage of the reference electrode is performed to solve the problem of shutdown afterimage. On the contrary, when the charge sharing thin film transistor in the drive of the display panel is not communicated with the data line, the electric energy stored in the Array Com cannot flow to the data line when the display panel is turned off, and the voltage of the data line will not be affected, so that the set voltage of the reference electrode does not need to be updated, and the occurrence of the afterimage phenomenon when the display panel is turned off can also be avoided.

In addition, when the gate lines are all opened in the drive of the display panel, the charge sharing thin film transistor must be communicated with the data line. Therefore, when the display panel is turned off, it is judged whether the gate line is fully open or not. When the gate line is fully open, the operation of updating the set voltage of the reference electrode is performed to solve the shutdown afterimage problem.

In this embodiment, it is detected whether a charge sharing thin film transistor in a drive of the display panel is communicated with the data line, in response to the display panel being turned off. When the charge sharing thin film transistor in the drive of the display panel is communicated with the data line, the operation of updating the set voltage of the reference electrode is performed to solve the problem of shutdown afterimage. On the contrary, when the charge sharing thin film transistor in the drive of the display panel is not communicated with the data line, the set voltage of the reference electrode does not need to be updated, and the occurrence of the afterimage phenomenon when the display panel is turned off can also be avoided.

In addition, the embodiment of the application also provides a method of eliminating the shutdown afterimage on the display panel.

Figure 9:
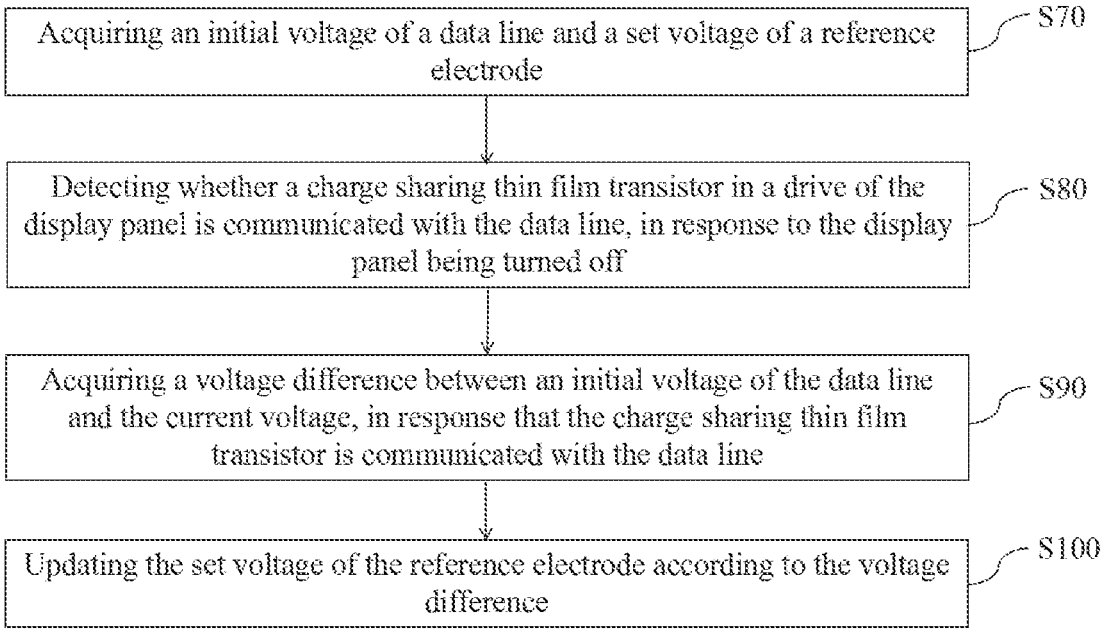
FIG. 9 is a flow chart of a method of eliminating a shutdown afterimage on a display panel according to a fifth embodiment of the present application.

Referring to FIG. 9, another embodiment of the method of eliminating the shutdown afterimage on the display panel, the method may include:

operation S70, acquiring an initial voltage of a data line and a set voltage of a reference electrode;

Before the display panel is shut down, the initial voltage of the data line (positive half-cycle voltage) and the set voltage of the reference electrode are detected by a voltage detecting element.

Operation S80, detecting whether a charge sharing thin film transistor in a drive of the display panel is communicated with the data line, in response to the display panel being turned off;

When the charge sharing thin film transistor of the display panel is communicated with the data line, the electric energy stored in the Array Com flows to the data line, which affects the voltage of the data line, and the voltage difference between the voltage level of the data line and the set voltage of the reference electrode increases, so that the charge in the pixel structure can not be effectively released, resulting in the problem of the shutdown afterimage of the display panel.

Operation S90, acquiring a voltage difference between an initial voltage of the data line and the current voltage, when the charge sharing thin film transistor is communicated with the data line;

Operation S100, updating the set voltage of the reference electrode according to the voltage difference.

It is detected whether a charge sharing thin film transistor in a drive of the display panel is communicated with the data line, in response to the display panel being turned off. When the charge sharing thin film transistor in the drive of the display panel is communicated with the data line, the current voltage of the data line is detected by the voltage detecting element, and the voltage difference between the current voltage and the initial voltage of the data line is calculated.

The reference electrode in the control system of the display panel is set as being modulated. When the display panel is turned off, the set voltage of the reference electrode is updated according to the initial voltage of the data line and the current voltage of the data line, so that the difference between the voltage level corresponding to the current voltage of the data line and the updated set voltage of the reference electrode is less than a certain value. Therefore, the charge in the pixel structure is effectively released, the image of the display panel turns black, and the afterimage problem is solved.

According to the different models of the display panel, after the display panel is turned off, the voltage difference is different to blacken the display panel for eliminating the shutdown afterimage. Usually, the value range of the voltage difference is from −0.5V to +0.5V.

For example, before a display panel is turned off, it is detected that a initial voltage of a data line is 4V and a set voltage of a reference electrode is 2V When the display panel is turned off, it is detected that the current voltage of the data line is 5V, and the voltage difference compared with the initial voltage is 1V. Then, the set voltage of the reference electrode is updated to 3V(4V+1V). That is, after the data line is affected by the Array Com, the voltage level of the data line changes by 1V. At this time, the set voltage of the reference electrode is adjusted by 1V accordingly, so that the difference between the voltage level of the data line and the voltage of the reference electrode remains unchanged, the charge in the pixel structure is released, and the screen of the display panel turns black, thus solving the problem of afterimage. It should be pointed out that in this example, if the value of the voltage difference is from −0.3V to +0.3V, updating the set voltage of the reference electrode to any value in the range from +4.7 V to +5.3V can solve the shutdown afterimage problem.

As shown in FIG. 4, after the display panel is turned off, the Array Com (A Com) influences the voltage of the electrode line (Data), and shifts the voltage level of the electrode line (the voltage level of the electrode line is between the positive half-cycle voltage and the negative half-cycle voltage of the electrode line, which is not shown in the figure). There is a large voltage difference between the voltage level of the electrode line and the set voltage of the reference electrode (C Com). After updating the set voltage of the reference electrode, as shown in FIG. 5, with the change of the voltage of the reference electrode (C Com), the voltage difference between the voltage level of the electrode line and the voltage of the reference electrode (C Com) is less, the charge in the pixel structure is released, and the display panel picture becomes black, thus solving the afterimage problem.

In addition, the updating method of the set voltage of the reference electrode is not limited to the above method provided in this embodiment, and any updating method of the set voltage of the reference electrode that can achieve the following effects after the set voltage is updated belongs to the protection scope of this application. The effect is that the voltage difference between the set voltage of the updated reference electrode and the voltage level of the data line is less than a certain voltage.

Further, the updating method of the set voltage of the reference electrode can be as follows: firstly, calculate the voltage difference between the initial voltage and the current voltage of the data line, and update the set voltage of the reference electrode according to the voltage difference. When updating the set voltage of the reference electrode according to the voltage difference, the set voltage of the reference electrode before updating and the voltage difference are added to obtain a voltage sum, and then the set voltage is updated according to the voltage sum. Specifically, a modulated voltage is determined according to the voltage sum, and the modulated voltage is taken as the updated set voltage of the reference electrode. The difference between the modulated voltage and the voltage sum is within a first preset range, so that the voltage difference between the updated set voltage and the voltage level of the data line is less than a certain voltage.

In addition, the method of updating the set voltage may be as follows: after acquiring the voltage difference between the initial voltage and the current voltage of the data line, a modulated voltage difference is determined according to the voltage difference, and the set voltage of the reference electrode is updated according to the modulated voltage difference. Specifically, the updated set voltage can be set as the sum of the modulated voltage difference and the set voltage before updating. Similarly, the difference between the modulated voltage difference and the voltage difference is within a second preset range, so that the voltage difference between the updated set voltage and the voltage level of the data line is less than a certain voltage.

It should be pointed out that the voltage difference mentioned in this application includes positive and negative values, and when the voltage difference is summed with other parameters, the positive and negative signs of the voltage difference should be taken into account.

According to different models of the display panel, different first preset ranges and second preset ranges are set. When the voltage difference between the voltage level of the data line and the set voltage of the reference electrode is less than a certain voltage, the display panel can be blackened after shutdown. Usually, ranges of the first preset range and the second preset range are from −0.5V to +0.5V. In this embodiment, the first preset range may be the same as or different from the second preset range.

Further, after acquiring the initial voltage and current voltage of the data line, the voltage difference between the current voltage and the initial voltage is calculated first. It is judged if the absolute value of the voltage difference is greater than the preset threshold. When the absolute value of the voltage difference is greater than the preset threshold, operation S30 is executed to adjust the set voltage of the reference electrode. When the absolute value of the voltage difference is less than the preset threshold, there is no need to execute the adjustment operation of the voltage. Reduce program operation and improve shutdown efficiency.

Further, it is detected whether a charge sharing thin film transistor in a drive of the display panel is communicated with the data line, in response to the display panel being turned off. When the charge sharing thin film transistor in the drive of the display panel is communicated with the data line, the operation of updating the set voltage of the reference electrode is performed to solve the problem of shutdown afterimage. On the contrary, when the charge sharing thin film transistor in the drive of the display panel is not communicated with the data line, the set voltage of the reference electrode does not need to be updated, and the occurrence of the afterimage phenomenon when the display panel is turned off can also be avoided.

Further, when the charge sharing thin film transistor of the display panel is communicated with the data line, the electric energy stored in the Array Com flows to the data line, which affects the voltage of the data line, and the voltage difference between the voltage level of the data line and the set voltage of the reference electrode increases, so that the charge in the pixel structure can not be effectively released, resulting in the problem of the shutdown afterimage of the display panel.

Therefore, it is detected whether a charge sharing thin film transistor in a drive of the display panel is communicated with the data line, in response to the display panel being turned off. When the charge sharing thin film transistor in the drive of the display panel is communicated with the data line, the operation of updating the set voltage of the reference electrode is performed to solve the problem of shutdown afterimage. On the contrary, when the charge sharing thin film transistor in the drive of the display panel is not communicated with the data line, the electric energy stored in the Array Com cannot flow to the data line when the display panel is turned off, and the voltage of the data line will not be affected, so that the set voltage of the reference electrode does not need to be updated, and the occurrence of the afterimage phenomenon when the display panel is turned off can also be avoided.

In addition, when the gate lines are all opened in the drive of the display panel, the charge sharing thin film transistor must be communicated with the data line. Therefore, when the display panel is turned off, it is judged whether the gate line is fully open or not. When the gate line is fully open, the operation of updating the set voltage of the reference electrode is performed to solve the shutdown afterimage problem.

In this embodiment, before the display panel is shut down, the initial voltage of the data line and the set voltage of the reference electrode are detected by a voltage detecting element. After the display panel is turned off, it is detected whether the charge sharing thin film transistor in the drive of the display panel is communicated with the data line. When the charge sharing thin film transistor in the driving of the display panel is communicated with the data line, the current voltage of the data line is detected. The reference electrode in the control system of the display panel is set as being modulated. When the display panel is turned off, the set voltage of the reference electrode is updated according to the initial voltage of the data line and the current voltage of the data line, so that the difference between the voltage level corresponding to the current voltage of the data line and the updated set voltage is less than a certain value. Therefore, the charge in the pixel structure is effectively released, the image of the display panel turns black, and the afterimage problem is solved.

Further, the present application provides a device of eliminating the shutdown afterimage on the display panel. The device includes a memory, a processor and a program for eliminating a shutdown image stored in the memory, the program including instructions, when executed by the processor, cause the device to implement the operations of eliminating the shutdown afterimage on the display panel as described in the aforementioned embodiments.

It should be noted that in this document, the terms "comprising" "including" or any other variation thereof are intended to cover a non-exclusive inclusion, such that a process, method, article, or system that includes a list of elements includes not only those elements but also other elements not expressly listed, or elements inherent to such process, method, article, or system. Without further restrictions, an element defined by the statement "includes an" does not exclude the presence of another identical element in a process, method, article, or system including the element.

The aforementioned serial numbers regarding the embodiments of the present application are for description only and do not represent the superiority and inferiority of the embodiments.

From the above description of the embodiments, those skilled in the art can clearly understand that the method of the above embodiments can be implemented by means of software plus necessary general-purpose hardware platforms. Of course, it can also be implemented by means of hardware, but in many cases the former is a better embodiment. Based on this understanding, the technical solution of the present application, in essence, or the part contributing to the prior art, can be embodied in the form of a software product stored in a storage medium (such as ROM/RAM, magnetic disk, diskette) as described above, including several instructions to cause a terminal device (which can be a mobile phone, computer, server, air conditioner, or network device, etc.) to perform the methods described in various embodiments of the present application.

The description aforementioned is only the optional embodiment of the present application and is not intended to limit the scope of the present application. Any equivalent structural or flow modification made by using the description and drawings of the present application or direct/indirect application in other related technical fields under the concept of the present application shall be included in the protection scope of the present application.

What is claimed is:

1. A method of eliminating shutdown afterimage on a display panel, comprising:

acquiring an initial voltage of a data line and a set voltage of a reference electrode;

acquiring a current voltage of the data line, in response to the display panel being turned off, and updating the set voltage of the reference electrode according to the initial voltage of the data line and the current voltage of the data line, comprises:

acquiring a voltage difference between the initial voltage of the data line and the current voltage of the data line; and updating the set voltage of the reference electrode according to the voltage difference.

2. The method of claim 1, wherein the operation of updating the set voltage of the reference electrode according to the voltage difference, comprises:

acquiring a voltage sum of the voltage difference and the set voltage of the reference electrode before updating; and updating the set voltage of the reference electrode according to the voltage sum.

3. The method of claim 2, wherein the operation of updating the set voltage of the reference electrode according to the voltage sum, comprises:

determining a modulated voltage according to the voltage sum, wherein a difference between the modulated voltage and the voltage sum is within a first preset range; and taking the modulated voltage as the set voltage of the reference electrode after updating.

4. The method of claim 1, wherein the operation of updating the set voltage of the reference electrode according to the voltage difference, comprises:

determining a modulated voltage difference according to the voltage difference, wherein a difference between the modulated voltage difference and the voltage difference is within a second preset range; and updating the set voltage of the reference electrode according to the modulated voltage difference.

5. The method of claim 4, wherein the second preset range is from −0.5V to +0.5V.

6. The method of claim 1, wherein prior to the operation of updating the set voltage of the reference electrode according to the initial voltage of the data line and the current voltage of the data line, the method further comprises:

acquiring a voltage difference between the current voltage of the data line and the initial voltage of the data line;

determining whether an absolute value of the voltage difference is greater than a preset threshold; and in response to the absolute value being greater than the preset threshold, executing the operation of updating the set voltage of the reference electrode according to the initial voltage of the data line and the current voltage of the data line.

7. The method of claim 3, wherein prior to the operation of updating the set voltage of the reference electrode according to the initial voltage of the data line and the current voltage of the data line, the method further comprises:

acquiring a voltage difference between the current voltage of the data line and the initial voltage of the data line;

determining whether an absolute value of the voltage difference is greater than a preset threshold; and in response to the absolute value being greater than the preset threshold, executing the operation of updating the set voltage of the reference electrode according to the initial voltage of the data line and the current voltage of the data line.

8. The method of claim 4, wherein prior to the operation of updating the set voltage of the reference electrode according to the initial voltage of the data line and the current voltage of the data line, the method further comprises:

acquiring a voltage difference between the current voltage of the data line and the initial voltage of the data line;

determining whether an absolute value of the voltage difference is greater than a preset threshold; and in response to the absolute value being greater than the preset threshold, executing the operation of updating the set voltage of the reference electrode according to the initial voltage of the data line and the current voltage of the data line.

9. The method of claim 1, wherein prior to the operation of acquiring a current voltage of the data line, the method further comprises:

detecting whether a charge sharing thin film transistor in a drive of the display panel is communicated with the data line, in response to the display panel being turned off; and executing the operation of acquiring the current voltage of the data line, if the charge sharing thin film transistor is communicated with the data line.

10. The method of claim 4, wherein prior to the operation of acquiring a current voltage of the data line, the method further comprises:

detecting whether a charge sharing thin film transistor in a drive of the display panel is communicated with the data line, in response to the display panel being turned off; and executing the operation of acquiring the current voltage of the data line, if the charge sharing thin film transistor is communicated with the data line.

11. A method of eliminating shutdown afterimage on a display panel, comprising:

acquiring an initial voltage of a data line and a set voltage of a reference electrode;

detecting whether a charge sharing thin film transistor in a drive of the display panel is communicated with the data line, in response to the display panel being turned off; and acquiring a voltage difference between the initial voltage of the data line and a current voltage, in response to that the charge sharing thin film transistor is communicated with the data line; and updating the set voltage of the reference electrode according to the voltage difference.

12. The method of claim 11, wherein the operation of detecting whether a charge sharing thin film transistor in a drive of the display panel is communicated with the data line, comprises:

if gate lines in the drive of the display panel are all turned on, determining that the charge sharing thin film transistor is communicated with the data line.

13. The method of claim 11, wherein the operation of updating the set voltage of the reference electrode according to the voltage difference, comprises:

acquiring a voltage sum of the voltage difference and the set voltage of the reference electrode before updating; and updating the set voltage of the reference electrode according to the voltage sum.

14. The method of claim 13, wherein the operation of updating the set voltage of the reference electrode according to the voltage sum, comprises:

determining a modulated voltage according to the voltage sum, wherein a difference between the modulated voltage and the voltage sum is within a first preset range; and taking the modulated voltage as the set voltage of the reference electrode after updating.

15. The method of claim 11, wherein the operation of updating the set voltage of the reference electrode according to the voltage difference, comprises:

determining a modulated voltage difference according to the voltage difference, wherein a difference between the modulated voltage difference and the voltage difference is within a second preset range; and updating the set voltage of the reference electrode according to the modulated voltage difference.

16. The method of claim 11, wherein prior to the operation of updating the set voltage of the reference electrode according to the initial voltage of the data line and the current voltage of the data line, the method further comprises:

acquiring a voltage difference between the current voltage of the data line and an initial voltage of the data line;

determining whether an absolute value of the voltage difference is greater than a preset threshold; and in response to the absolute value being greater than the preset threshold, executing the operation of updating the set voltage of the reference electrode according to the initial voltage of the data line and the current voltage of the data line.

17. A device of eliminating a shutdown afterimage on a display panel, wherein the device comprises a memory, a processor and a program for eliminating a shutdown image stored in the memory, the program including instructions, when executed by the processor, cause the device to:

acquiring an initial voltage of a data line and a set voltage of a reference electrode;

acquiring a current voltage of the data line, in response to the display panel being turned off, and updating the set voltage of the reference electrode according to the initial voltage of the data line and the current voltage of the data line, comprises:

acquiring a voltage difference between the initial voltage of the data line and the current voltage of the data line; and updating the set voltage of the reference electrode according to the voltage difference.

18. The device of claim 17, wherein prior to the operation of updating the set voltage of the reference electrode according to the initial voltage of the data line and the current voltage of the data line, the device is further caused to:

acquiring a voltage difference between the current voltage of the data line and the initial voltage of the data line;

determining whether an absolute value of the voltage difference is greater than a preset threshold; and in response to the absolute value being greater than the preset threshold, executing the operation of updating the set voltage of the reference electrode according to the initial voltage of the data line and the current voltage of the data line.

* * * * *